United States Patent [19]

Magnus et al.

[11] 4,170,489

[45] Oct. 9, 1979

[54] PROCESS FOR CLEANING JET ENGINE NOZZLES

[75] Inventors: Harve W. Magnus, Manhattan Beach, Calif.; Vincent J. Masur, Kansas City, Mo.

[73] Assignee: Teledyne Sprague Engineering Division of Teledyne, Inc., Gardena, Calif.

[21] Appl. No.: 927,552

[22] Filed: Jul. 24, 1978

Related U.S. Application Data

[62] Division of Ser. No. 841,008, Oct. 11, 1977.

[51] Int. Cl.[2] ..... B08B 9/00

[52] U.S. Cl. ..... 134/22 R; 134/29; 134/30; 134/39; 60/39.33; 431/121

[58] Field of Search ..... 134/29, 39, 30, 37, 134/40, 22 R, 18, 34, 94, 26; 239/1, 112, 171, 106; 60/39.54, 39.33, 39.46 R; 123/198 F, 198 DB; 431/121

[56] References Cited

U.S. PATENT DOCUMENTS

| | | | |
|---|---|---|---|
| 1,584,505 | 5/1926 | Bevins | 134/30 |
| 2,689,456 | 9/1954 | White | 60/39.33 |
| 4,095,418 | 6/1978 | Mansson et al. | 431/121 |

FOREIGN PATENT DOCUMENTS

| | | | |
|---|---|---|---|
| 1099311 | 9/1955 | France | 60/39.33 |

*Primary Examiner*—S. Leon Bashore
*Assistant Examiner*—Michael Goldman
*Attorney, Agent, or Firm*—Keith D. Beecher

[57] ABSTRACT

A process is provided for cleaning residue fuel varnish and carbon from the fuel nozzles and guide vanes of a jet engine. The process involves dispensing a detergent and water solution under sufficient pressure through the fuel nozzles themselves to scrub residue fuel varnish and carbon from the fuel nozzles and from the guide vanes of a jet engine of an aircraft; without the need for removing the engine from the aircraft, or for removing the nozzles from the engine. The process serves to wet down the surfaces of the fuel nozzles and guide vanes with a detergent solution for a period of time (that is about 20 minutes), and then to scour the surfaces with a pulsating detergent spray, and finally to purge and dry the surfaces with a pressurized air stream.

6 Claims, 3 Drawing Figures

PROCESS FOR CLEANING JET ENGINE NOZZLES

This is a division of copending application Ser. No. 841,008, filed Oct. 11, 1977.

BACKGROUND OF THE INVENTION

It has been the usual practice during overhaul to remove the fuel nozzles and guide vanes from the jet engines of an aircraft, and to soak the parts in an appropriate solution so as to remove the residue fuel varnish and carbon from the surfaces thereof. However, such a procedure is time-consuming and costly.

The process of the present invention causes a high pressure spray of water and detergent solution to be emitted from the fuel nozzles of the jet engine, with the fuel nozzles and guide vanes in place in the engine, in order to clean the nozzles and guide vanes thoroughly without the need to dismantle the same from the engine.

A feature of the process is that it operates entirely by penumatic means and without electricity, so that it may be carried out in any atmosphere without danger of explosion and thereby be safe for hangar use.

DETAILED DESCRIPTION OF THE ILLUSTRATED EMBODIMENT

Figure 1A:
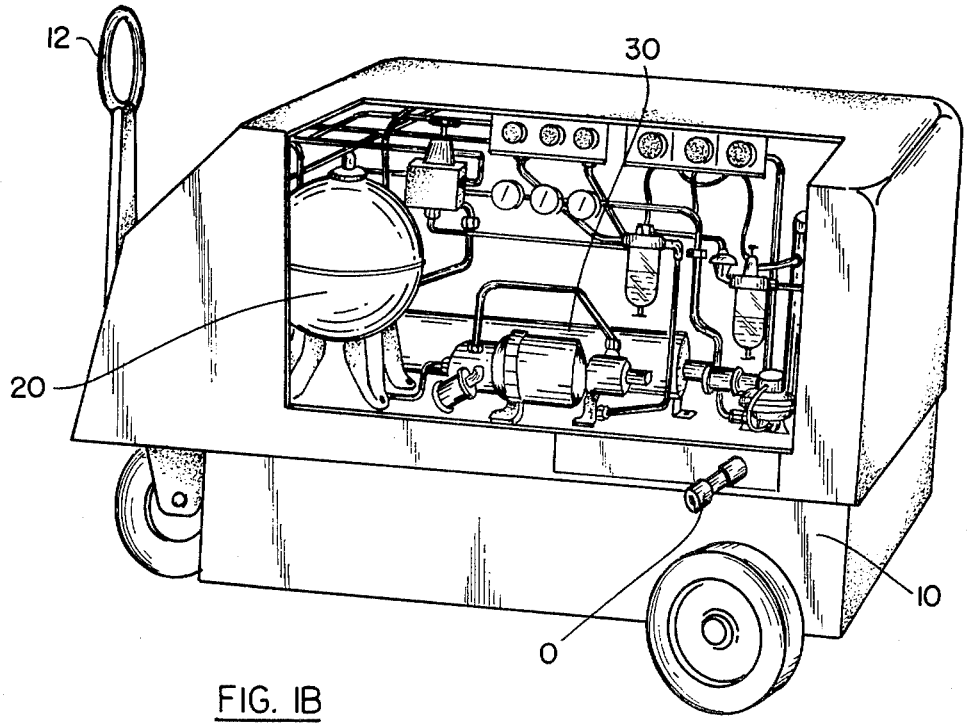
FIGS. 1A and 1B are pictorial representations of apparatus constructed to carry out the process of the invention.
Figure 1B:
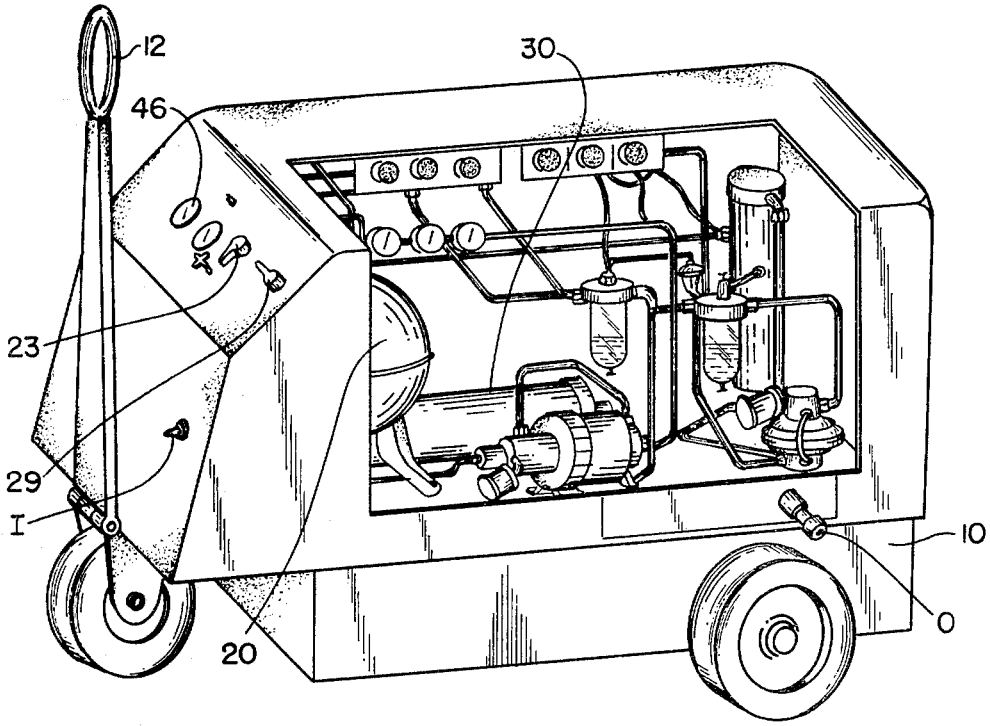

As shown in FIGS. 1A and 1B, the apparatus which carries out the process of the invention may be mounted on a three-wheeled cart 10 which may be towed to the work site by a handle 12.

Figure 2:
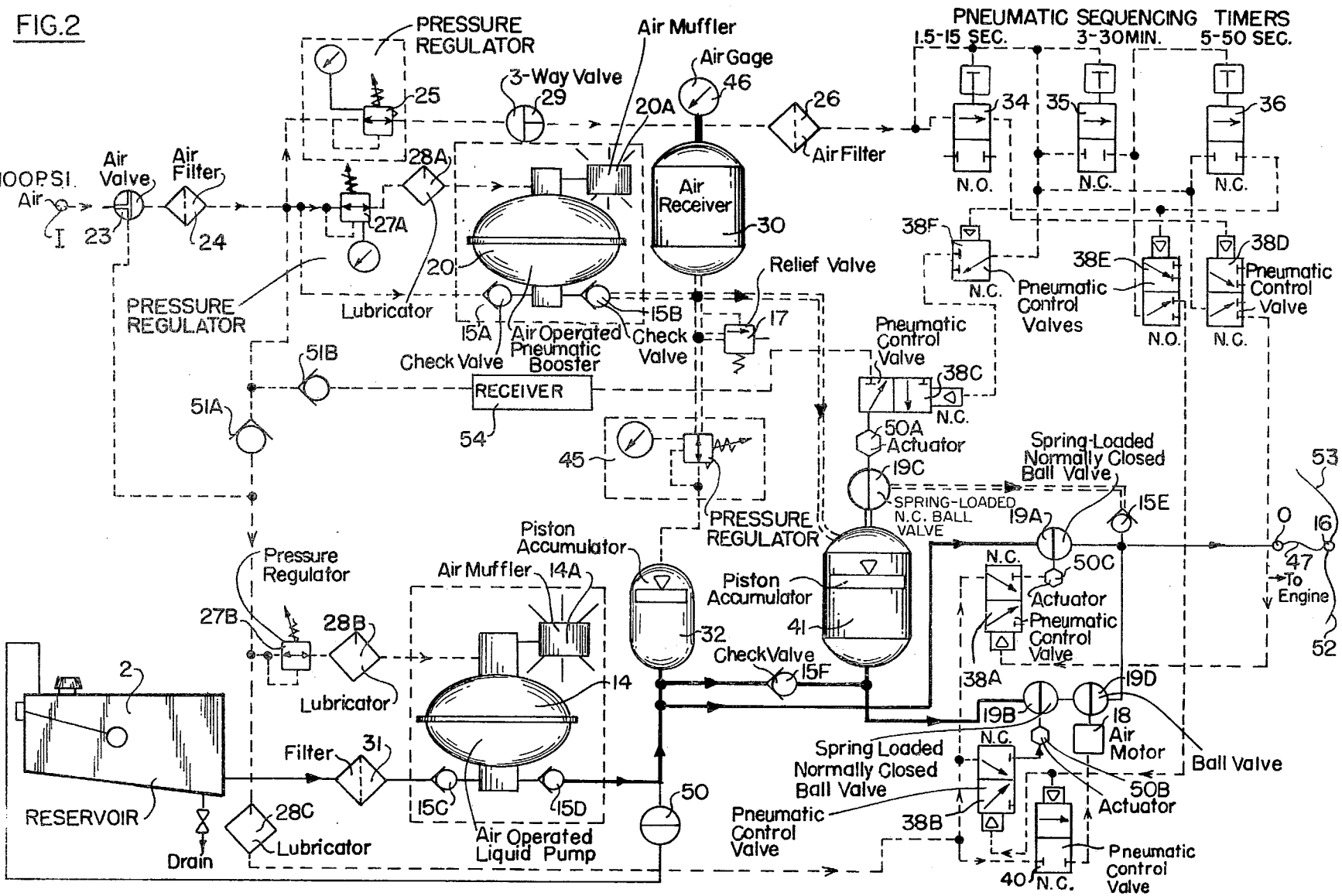
FIG. 2 is a schematic functional diagram of the apparatus of FIG. 1.

In the schematic diagram of FIG. 2, compressed air of a pressure, for example, of 100 psi is introduced through an inlet "I," and through a 3-way air supply valve 23 and 10 micron air filter 24, and through a pressure regulator 27A and lubricator 28A to an air operated penumatic booster pump 20, the pump being equipped with an appropriate air muffler 20A. Valve 23 has an "on" position in which compressed air is supplied to the booster pump 20; a "mix" position illustrated in FIG. 2; and an "off" position. Booster pump 20 is coupled through a check valve 15B to an air receiver 30, and is coupled back through a check valve 15A to the inlet of regulator 27A. The outlet of filter 24 is also coupled through a pressure regulator 25, and through a three-way valve 29 and air filter 26 to a series of pneumatic sequencing timers 34, 35 and 36, the timer 34 being normally open, and the timers 35 and 36 being normally closed.

Timer 34 may be set to close within a time range, for example, of 1.5–15 seconds; the timer 35 may be set to open within a time range of 3–30 minutes, for example; and the timer 36 may be set to open within a time range of 5–50 seconds, for example.

The output of timer 34 is coupled to a pneumatic control valve 38D, and the output of timer 36 is coupled to pneumatic control valves 38E and 38F. The output of timer 35 is coupled through a normally open portion of control valve 38E to a pneumatic control valve 38B and to a further pneumatic control valve 40. The output of air filter 26 is also passed through a normally closed portion of pneumatic control valve 38D to a pneumatic control valve 38A.

The output of booster pump 20 is introduced through check valve 15B to the air receiver 30, whose internal pressure is designated by a gage 46. Air receiver 30 is coupled through a pressure regulator 45 to a relatively small piston-type accumulator 32 whose capacity, for example, may be one gallon; and the air receiver is directly coupled to a relatively large piston-type accumulator 41 whose capacity for example, may be five gallons. A relief valve 17 is provided in the line between the air receiver 30 and piston accumulator 32.

The pressure regulator 45 reduces the pressure introduced to accumulator 32 from the air receiver 30 to a relatively low value, so that a detergent solution is emitted from the accumulator 32 at relatively low pressure; whereas the air receiver is directly coupled to the accumulator 41 so that a solution discharged from the accumulator 41 is at relatively high pressure.

The output of air filter 24 is also passed through a check valve 51A and a pressure regulator 27B and through a lubricator 28B to an air-operated liquid pump 14, and through a check valve 51B and receiver 54 to the normally closed pneumatic control valve 38C. Pump 14 is equipped with a muffler 14A. Receiver 54 is included to insure adequate pressure to operate actuator 50A when the apparatus is operated on marginal air supply systems. When valve 38C is opened, the air pressure from the receiver 54 passes to the actuator 50A which controls a spring-loaded normally closed valve 19C. When valve 19C is opened, pressurized air from accumulator 41 and air receiver 30 is discharged to an outlet O through check valve 15E.

A reservoir 2 for a water and detergent solution is provided in the apparatus, and is coupled through a 25 micron filter 31 and through a check valve 15C to pump 14. Pump 14 pumps the detergent through a check valve 15D into accumulator 32, and through an additional check valve 15F into accumulator 41. Accumulator 32 discharges its contents through a spring-loaded normally closed ball valve 19A to outlet O; and accumulator 41 discharges its contents through a spring-loaded normally closed ball valve 19B and through a motor-operated ball valve 19D to outlet O. Outlet O is coupled to an appropriate hose 47 which is equipped with a fitting 16 and two short hoses 52 and 53.

In the operation of the apparatus, the fuel system is interrupted by disconnecting it from the fuel nozzles, and the hoses 52 and 53 are attached to the fuel system and coupled to the nozzles, so that the detergent solution may be discharged through the nozzles to perform the desired cleaning function. The jet engine usually includes primary and secondary fuel injection systems. Hoses 52 and 53 provide connections to both systems. The hoses provide flexibility for connection to the rigid fuel lines of the engine.

A by-pass circuit for pump 14 through a shut-off valve 50 is provided, as well as an independent driving air supply for the pump through valve 23 in its "mix" position (illustrated in FIG. 2). This provides a mixing circuit for the detergent in reservoir 2 which has a tendency to separate out of solution if left standing for any length of time. To initiate a "mix" cycle, it is merely necessary to turn valve 23 to its illustrated "mix" position and open valve 50. Driving air is now supplied to the liquid pump 14 only, and the solution is circulated through reservoir 2.

The output of air filter 24 is also introduced through a check valve 51A, through a lubricator 28C, and through the normally closed control valve 38A to an actuator 50C which operates valve 19A. When valve 38A is opened, the actuator 50C is caused to open the valve 19A and discharge the contents of accumulator 32 through outlet O. The output from the air filter 24 is also introduced through the normally closed control valve 38B to an actuator 50B which operates the spring-loaded valve 19B. When the control valve 38B is opened, the valve 19B is opened. The pressurized air from the air filter 24 is also applied to the normally closed control valve 40, and when the valve 40 is operated, an air motor 18 is actuated which causes the valve 19D to rotate, intermittently to open and close. When valve 19B is opened, and when motor 18 is activated, intermittent bursts of the contents of accumulator 41 are introduced to outlet O.

To operate the system of FIG. 2, the air supply valve 23 is opened, causing the booster pump 20 to operate and pump air into the air receiver 30, until an air pressure in the air receiver of, for example, 500 psi is indicated by gage 46. At the same time, the pump 14 pumps the detergent solution from reservoir 2 into the accumulators 32 and 41, until both accumulators are filled with the detergent solution.

When the gage 46 indicates an air pressure of 500 psi in the air receiver 30, for example, the valve 29 is opened to start the sequence of operations in the system. When the valve 29 is open the pressurized air from air filter 26 passes through the timer 34 to the control valve 28D to operate the control valve 38D. This causes the pressurized air to flow through the control valve 38D to operate the control valve 38A. When control valve 38A is operated, it causes actuator 50C to open valve 19A. The air pressure from receiver 30 now forces the piston in accumulator 32 downwardly to cause the detergent solution within the accumulator 32 to be discharged through valve 19A, and through the outlet O of the system to the fuel nozzle of the jet engine. This initial discharge of about one gallon of the detergent solution through the nozzles is under relatively low pressure, and it serves to wet the surfaces of the nozzle and guide vanes of the jet engine.

After a selected time interval established by the setting of timer 34, (e.g. 1.5–15 seconds) the timer 34 closes, and the control valve 38D returns to its normally closed position, causing control valve 38A to turn off valve 19A to terminate the discharge of low pressure detergent from accumulator 32. After a preset time interval (e.g. 3–30 minutes) during which pump 14 and booster 20 recharge, timer 35 opens. The pressurized air from timer 35 flows through valve 38E to operate valves 38B and 40, so that the latter control valves are opened. The opening of valve 38B causes actuator 50B to open valve 19B, and the opening of valve 40 causes air motor 18 to open and close valve 19D. The contents of the accumulator 41 are then forced through valves 19B and 19D to be emitted as pulsations of detergent solution through the nozzles under relatively high pressure from the outlet O, and subsequently through the nozzles of the jet engine being cleaned. The flow rate in a constructed embodiment, for example, is 25 gallons per minute.

The timer 36 times out after a preset time, in the range for example, of 5–50 seconds. When that occurs, the timer 36 causes the control valve 38E to close, and causes control valve 38F to open. When control valve 38E closes, both valves 38B and 40 close to terminate the intermittent flow of detergent to outlet O. When control valve 38F opens, valve 38C is opened to cause actuator 50A to open valve 19C. The opening of valve 19C by actuator 50A causes pressurized air to flow from accumulator 41 and air receiver 30 through check valve 15E, and through outlet O to the nozzle of the jet engine to air dry the surfaces of the jet engine wetted by the detergent emission from the apparatus. Valve 29 must be actuated to terminate venting of air receiver 30 and accumulator 41 when pressure indicated on gage 46 is approximately 100 psi. Valve 29 is a three-way valve, and it is now turned to its second position to interrupt the introduction of pressurized air to the control system, and to vent and reset the timers 34, 35 and 36. The air receiver 30 now re-charges, and the cycle may be repeated after the predetermined pressure is indicated by gage 46, by again turning valve 29.

The operation of the apparatus, as described in FIG. 2, therefore, first causes a small amount of detergent solution to be emitted by the nozzle of the jet engine for cleaning purposes. Then, under the automatic control of the system of FIG. 2, pulsating jets of the detergent solution are emitted at high pressure through the fuel nozzle of the jet engine thoroughly to clean the nozzle and the guide vanes of residue fuel varnish and carbon deposits. After a predetermined time, the pulsating jets of the detergent solution are terminated, and a stream of pressurized air is emitted through the nozzle to dry the wetted surfaces of the nozzle and of the guide vanes of the engine.

The invention provides, therefore, a relatively simple process which automatically enables the nozzles and guide vanes of jet engines to be thoroughly cleaned without any need for dismantling the same, and in a simple and expeditous manner. As mentioned above, the process of the invention in the embodiment described above is advantageous in that it is completely penumatic in its operation, so as to be capable of use in aircraft hangars without any danger of creating fires or explosions.

While a particular embodiment of the invention has been shown and described, modifications may be made. It is intended in the following claims to cover all modifications which come within the spirit and scope of the invention.

What is claimed is:

1. A process for cleaning the fuel nozzles and guide vanes of jet engines, and the like, which comprises disconnecting the fuel system of the engine from the fuel nozzles; introducing a pressurized stream of cleaning solution into the fuel nozzles to be emitted through the fuel nozzles.

2. The process defined in claim 1, and which includes a first step of initially introducing the cleaning solution at relatively low pressure into the fuel nozzles for wetting purposes, and a second step after a predetermined time interval for subsequently introducing a cleaning solution at relatively high pressure into the fuel nozzles.

3. The process defined in claim 2, and which includes a step of causing the relatively high pressure stream of cleaning solution to be introduced as intermittent bursts into the fuel nozzles.

4. The process defined in claim 1, and which includes a step of subsequently introducing an air stream into the fuel nozzles of the engine to be emitted through the fuel nozzles for drying purposes.

5. The process defined in claim 1, in which the pressurized stream of cleaning solution is introduced to the fuel nozzles as intermittent bursts.

6. The process defined in claim 5, and which includes the step of subsequently introducing an air stream to the fuel nozzles of the engine to be emitted through the fuel nozzles for drying purposes.

* * * * *